US006045436A

United States Patent [19]

Rieger et al.

[11] Patent Number: 6,045,436

[45] Date of Patent: Apr. 4, 2000

[54] PROCESS FOR THE MATERIAL-ABRADING MACHINING OF THE EDGE OF A SEMICONDUCTOR WAFER

[75] Inventors: Alexander Rieger, Kirchdorf; Simon Ehrenschwendtner, Winhöring, both of Germany

[73] Assignee: Wacker Siltronic Gesellschaft für Halbleitermaterialien AG, Burghausen, Germany

[21] Appl. No.: 08/906,573

[22] Filed: Aug. 5, 1997

[30] Foreign Application Priority Data

Sep. 5, 1996 [DE] Germany ..... 196 36 055

[51] Int. Cl.[7] ..... B24B 9/06

[52] U.S. Cl. ..... 451/44; 451/41; 451/57; 451/58; 451/443

[58] Field of Search ..... 451/41, 44, 57, 451/58, 444, 443

[56] References Cited

U.S. PATENT DOCUMENTS

| | | | |
|---|---|---|---|
| 5,295,331 | 3/1994 | Honda et al. | 451/44 |
| 5,316,620 | 5/1994 | Hasegawa et al. | 451/57 |
| 5,609,514 | 3/1997 | Yasunaga et al. | 451/44 |
| 5,658,189 | 8/1997 | Kagamida | 451/44 |
| 5,725,414 | 3/1998 | Moinpour et al. | 451/44 |
| 5,816,897 | 10/1998 | Raeder et al. | 451/44 |

FOREIGN PATENT DOCUMENTS

| | | |
|---|---|---|
| 0308134 | 3/1989 | European Pat. Off. . |
| 0663264 | 7/1995 | European Pat. Off. . |
| 19535616 | 4/1996 | Germany . |

OTHER PUBLICATIONS

English Derwent Abstract corresponding to DE 195 35 616 A 1 (96–173528).

K. E. Puttick, Proceedings of the 1993 Spring Topical Meeting of the American Society for Precision Engineering, Tuscon, Arizona, 1993.

M. Kerstan et al., Proceedings of the 1994 Annual Meeting of the American Society for Precision Engineering, Cincinnati, 1994.

Patent Abstracts of Japan, vol. 009, No. 252. (G–420), Oct. 9, 1985 & JP 60 104644 A (Mitsubishi Kinzoko Ku), Jun. 10, 1985.

"Machining Technology—The efficiency of the ultrasonic devices . . . " Kiseler et al., vol. 15, No. 2, Feb. 1, 1995,pp. 76–83, XP000552057.

*Primary Examiner*—Robert A. Rose
*Assistant Examiner*—George Nguyen
*Attorney, Agent, or Firm*—Collard & Roe, P.C.

[57] ABSTRACT

In a process for the material-abrading machining of the edge of a semiconductor wafer, the semiconductor wafer is resting on a rotationally movable table, is rotated about a central axis and is machined by a plurality of rotating machining tools. It is intended for each of the machining tools to abrade a specific quantity of material from the edge of the semiconductor wafer. The process is one in which the machining tools, during the course of a 360°-rotation of the semiconductor wafer, are successively advanced toward the edge of the semiconductor wafer and ultimately simultaneously machine the edge of the semiconductor wafer. A machining tool which has just been advanced is intended to abrade a smaller quantity from the edge of the semiconductor wafer than a previously advanced machining tool. The machining of the edge of the semiconductor wafer with one machining tool is terminated at the earliest once the semiconductor wafer has rotated through 360°, calculated from the advancement of this machining tool.

5 Claims, 1 Drawing Sheet

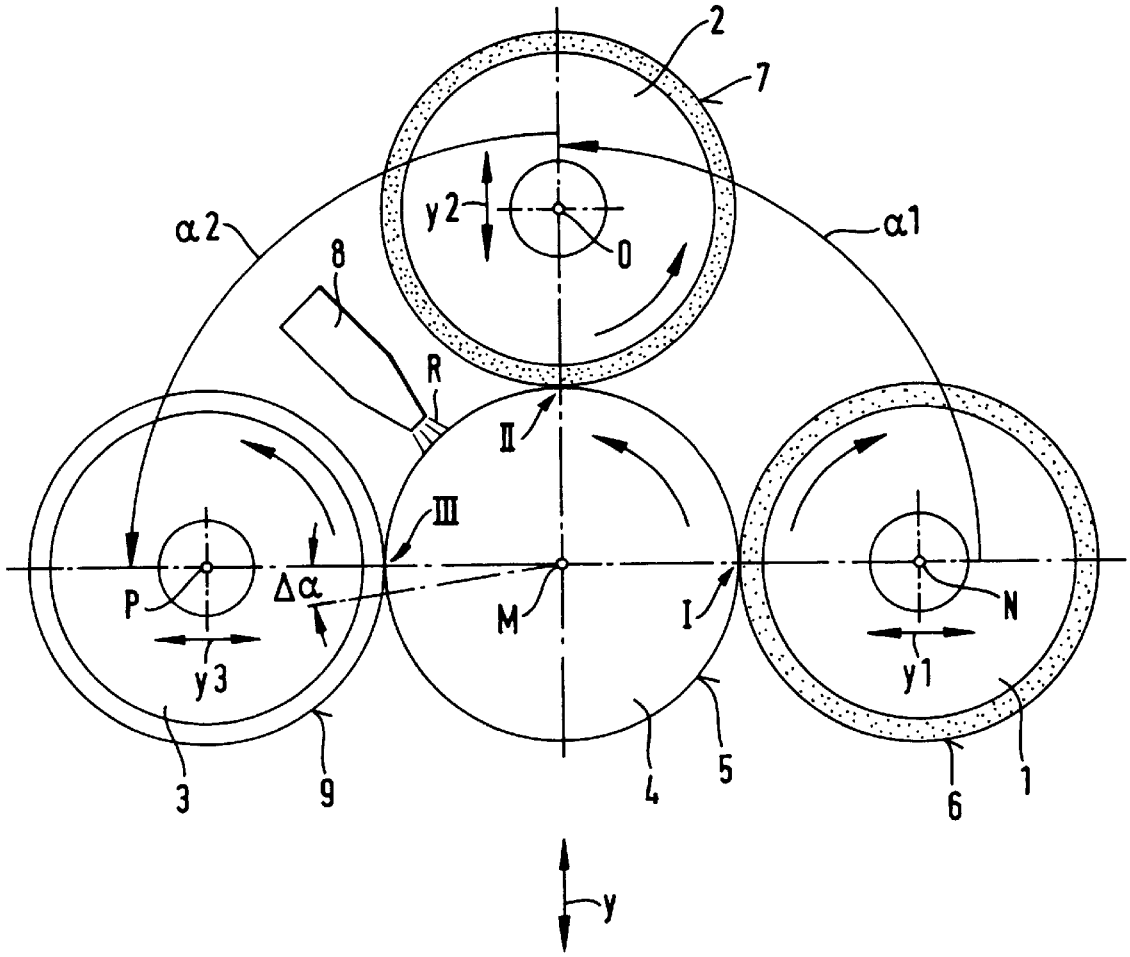
2
7
α2
α1
y2
O
8
R
II
III
P
Δα
M
I
N
y3
y1
3
9
4
5
6
1
y

PROCESS FOR THE MATERIAL-ABRADING MACHINING OF THE EDGE OF A SEMICONDUCTOR WAFER

BACKGROUND OF THE INVENTION

1. Field of the Invention

The present invention is a process for the material-abrading machining of the edge of a semiconductor wafer, for the purpose of creating a smooth edge surface which has a specific profile.

2. The Prior Art

The untreated edge of a semiconductor wafer cut from a single crystal has a comparatively rough and uneven surface. It frequently breaks when subjected to mechanical load and is a source of interfering particles. It is therefore customary to smooth the edge and to impart a specific profile thereto. This is carried out by material-abrading machining of the edge using a suitable machining tool. DE-195 35 616 A1 describes a grinding appliance which can be used to carry out such machining. During the machining, the semiconductor wafer is fixed to a rotating table and its edge is advanced against the likewise rotating working surface of a machining tool. One advantage of this appliance that it is suitable for machining the edge of the semiconductor wafer incrementally using different kinds of machining tools.

SUMMARY OF THE INVENTION

It is an object of the present invention to improve the material-abrading machining of the edge of a semiconductor wafer such that it is carried out even more effectively.

The above object is achieved according to the present invention by providing a process for the material-abrading machining of the edge of a semiconductor wafer. The semiconductor wafer is resting on a rotationally movable table, is rotated about a central axis and is machined by a plurality of rotating machining tools. It is intended for each of the machining tools to abrade a specific quantity of material from the edge of the semiconductor wafer. The machining tools, during the course of a 360°-rotation of the semiconductor wafer, are successively advanced against the edge of the semiconductor wafer and ultimately simultaneously machine the edge of the semiconductor wafer. A machining tool which has just been advanced is intended to abrade a smaller quantity from the edge of the semiconductor wafer than a previously advanced machining tool. The machining of the edge of the semiconductor wafer with one machining tool is terminated at the earliest once the semiconductor wafer has rotated through 360°. This is calculated from the initial advancement of this machining tool.

The process provides a huge saving of time, since the edge is for a time machined simultaneously with different kinds of machining tools. The machining can be concluded even after fewer than two revolutions of the semiconductor wafer. It is possible to use two or more, preferably 2 to 5, machining tools of different types.

The machining tools employed in the process of the invention are preferably designed as wheels which are fastened to a spindle. These wheels have circumferential surfaces which serve as working surfaces for machining the edge of the semiconductor wafer. As disclosed in the above-mentioned DE-195 35 616 A1, the circumferential surfaces may be curved with respect to the axis of the spindle and form recesses corresponding to the desired edge profile. Furthermore, it is possible for a plurality of wheels to rest one above the other in a stack. It is also possible to combine identical or different machining tools in the stack.

Preferred machining tools are grinding tools, polishing tools and tools for ductile grinding. The material-abrading abrasive grains for the grinding tools are normally fixedly anchored in the working surface of the grinding tool. Furthermore, cloths impregnated with abrasive grains are also known, in which cloths the abrasive grain is less fixedly embedded. They can also be used for polishing the edge of a semiconductor wafer. Other polishing tools cause material abrasion in a chemical-mechanical manner. In this case, if appropriate, it is necessary to supply a polishing abrasive to the working surface of the polishing tool. If grinding tools with a sufficiently small abrasive grain size and an extremely precise advance are used, the advance will make it possible to work at below a critical penetration depth (which for example for silicon is 100 nm (K. Puttik, *Proc. of the Spring Topical Meeting of the American Society for Precision Engineering, Tucson* 1993)). The material to be machined can be abraded in a ductile manner (without crack formation). Particularly smooth surfaces can be produced using this ductile grinding (M. Kerstan et al. in: *Proc. American Soc. for Precision Engineering,* Cincinnati 1994).

The material abrasion caused by a machining tool during machining of the edge of a semiconductor wafer is usually expressed by indicating the thickness of the layer of material removed. Typically, when machining the edge of a semiconductor wafer, material on the order of magnitude of 0.5 to 500 $\mu$m is abraded. For the purposes of the invention, two machining tools are considered as being of different types (identical) if, under identical conditions, they cause a different (identical) abrasion of material. In the case of grinding tools, the size of the abrasive grain used is the decisive factor in determining the material abrasion which the grinding tool is to cause. Furthermore, the material abrasion which it is desired to achieve using a grinding tool will normally be greater than the material abrasion which it is desired to achieve using a polishing tool or using a tool for ductile grinding.

To carry out the process, a semiconductor wafer is fixed on a rotationally movable table, a so-called chuck. The edge of the semiconductor wafer projects beyond the edge of the table, so that it is readily accessible to the machining tools. It is preferred for the table to hold the semiconductor wafer in a horizontal plane and to be displaceably mounted. Thus, the semiconductor wafer can if necessary be transported to the machining tools. The essential feature of the invention is that two or more machining tools of different types are used and that these tools are successively advanced to the edge during one revolution of the semiconductor wafer. The sequence of the advance depends on the material abrasion which it is intended to achieve with a machining tool. Firstly, the machining tool which is intended to cause the greatest abrasion of material is advanced. The advance is then continued with the machining tool which is intended to cause the next lowest abrasion of material, and so on. For example, the process could be employed in order to use two grinding tools to execute a coarse and a precision grinding of the edge of a semiconductor wafer simultaneously, at least for a time period. Similarly, the edge could be ground and polished, or ground and ground ductile, in one operation using machining tools which are deployed in a corresponding sequence.

A preferred embodiment of the process provides for machining tools which are adjacent in terms of their advance to rotate in opposite directions. This will avoid loose material which has been thrown forward by a machining tool from being transported back towards the edge of the semiconductor wafer by the adjacent machining tool.

Furthermore, it is expedient to feed a liquid cleaning agent, to which ultrasound or megasound has optionally been applied, to the edge at at least one point. The cleaning agent is preferably supplied to a point on the edge which has already been machined by a grinding tool. Also, this supplying is just before the machining by a polishing tool or a tool for ductile grinding.

All the machining tools used are advanced during one 360° rotation of the semiconductor wafer. Once all the machining tools have been advanced, they simultaneously machine the edge of the semiconductor wafer. The machining of the edge of the semiconductor wafer with one specific machining tool is terminated at the earliest once the semiconductor wafer has rotated through 360°. This is calculated from the advance of this machining tool. In the case of the machining tool which was advanced last, it is preferred for the machining of the edge by this machining tool to be terminated at the earliest once the semiconductor wafer has rotated through a feed angle of $\alpha=360°+\Delta\alpha$ since the advance of this machining tool. The additional grinding angle $\Delta\alpha$ only needs to be a few degrees. This ensures removal of a step which may have formed on the surface of the edge when the machining tool was applied.

The end of the machining of the edge of the semiconductor wafer with one machining tool is brought about by withdrawing this machining tool from the edge. The machining tools can be withdrawn simultaneously or in the sequence in which the machining tools had been advanced toward the edge. Preferably, the machining of the edge is terminated before the semiconductor wafer has completed two complete 360° rotations. This is calculated from the advance of the first machining tool. It is particularly preferred for the machining of the edge of the semiconductor wafer to be terminated as follows. This is done either by withdrawing all the machining tools simultaneously or by withdrawing last the machining tool which was deployed last. This occurs after the semiconductor wafer has rotated through a feed angle of $\alpha=360°+\Delta\alpha$ since the advance of the machining tool which was advanced last.

BRIEF DESCRIPTION OF THE DRAWINGS

Other objects and features of the present invention will become apparent from the following detailed description considered in connection with the accompanying drawing which discloses an embodiment of the present invention. It should be understood, however, that the drawing is designed for the purpose of illustration only and not as a definition of the limits of the invention.

The one FIGURE diagrammatically shows a plan view of a semiconductor wafer and the three machining tools of different types by means of which the edge of the semiconductor wafer is machined. Only those features which contribute to an understanding of the invention are illustrated.

DETAILED DESCRIPTION OF PREFERRED EMBODIMENTS

Turning now in detail to the drawings, the semiconductor wafer is transported into a machining position along a y-axis. A table, to which the semiconductor wafer 4 is fixed, rotates the wafer at a specific feed rate about a center axis M. The machining of the edge 5 of the semiconductor wafer 4 begins with the advance of a first machining tool 1 along a $y_1$-axis. The working surface 6 of the machining tool 1, which rotates clockwise about an axis N, acts on the edge 5 of the semiconductor wafer 4 in a contact zone I. A second machining tool 2, which rotates counterclockwise about an axis 0, is advanced as the next machining tool along a $y_2$-axis. Its working surface 7 begins machining the wafer edge 5 in a contact zone II. Between the advance of the first machining tool 1 and the advance of the second machining tool 2, the semiconductor wafer rotates through the feed angle $\alpha_1$. This marks the position of the contact zone II and, in the example illustrated, has the value $\alpha_1=90°$. Finally, in a corresponding manner, a third machining tool 3, which rotates counterclockwise about an axis P, is advanced along a $y_3$-axis. A device 8 for supplying a cleaning agent R, for example a megasonic nozzle, is situated between the machining tool 2 and the machining tool 3. The working surface 9 of the machining tool 3 begins machining the edge 5 in a contact zone III. Between the advance of the first machining tool 1 and the advance of the third machining tool 3, the semiconductor wafer rotates counterclockwise through the feed angle $\alpha_1+\alpha_2$. This marks the position of the contact zone III and, in the example illustrated, has the value $\alpha_1+\alpha_2=180°$.

In a corresponding manner, each further machining tool n (not shown in the FIGURE) would be advanced along a $y_n$-axis and would begin machining the edge in a contact zone Xn. The location of the contact zone Xn would in turn result from the feed angle through which the semiconductor wafer rotates between the advance of the first and the advance of the n-th machining tool.

In accordance with the preferred embodiment of the process, the machining tool 3 is withdrawn along the $y_3$-axis from the edge 5 of the semiconductor wafer. This occurs once the semiconductor wafer has completed a rotation of 360° and the excess grinding angle $\Delta\alpha$ since the advance of this machining tool. $\Delta\alpha$ can range from 5 degrees to 30 degrees. If the machining tools 1 and 2 have not yet been withdrawn from the edge by this time, they are withdrawn along the $y_1$-axis or the $y_2$-axis at the same time as the withdrawal of the processing tool 3. Then the table on which the semiconductor wafer is lying is moved along the y-axis into an unloading position. The semiconductor wafer 4 is replaced by another one with an as yet unmachined edge for a new machining cycle.

From the FIGURE in the drawings, it will be clear that the number of machining tools employed can be increased if the machining tools have smaller diameters. The diameter of the machining tools also plays an important role with regard to minimizing the duration of the machining of the edge of a semiconductor wafer. During the machining of the edge, the semiconductor wafer rotates through a specific overall feed angle. The smaller this overall feed angle, the shorter the duration of machining. The preferred overall feed angle is composed of a feed angle through which the semiconductor wafer rotates. (This is calculated from the advance of the machining tool advanced first). This rotation is until all the machining tools have been advanced. The feed angle which has already been mentioned is $360°+\Delta\alpha$, through which the semiconductor wafer then rotates further until completion of the machining. The value of the feed angle mentioned first depends on the distances between the machining tools and thus also on the diameter of the machining tools. The distance between adjacent machining tools can be indicated by an angle of offset.

In the drawings, the angle of offset between the machining tool 1 and the machining tool 2 corresponds to the feed angle $\alpha_1$ and is 90°. The angle of offset between the machining tool 2 and the machining tool 3 corresponds to $\alpha_2$ and is likewise 90°. The semiconductor wafer has rotated through a feed angle of 180° by the time the machining tool 3 is advanced. The machining of the semiconductor wafer would consequently require a total time corresponding to the time taken for the semiconductor wafer to rotate through an overall feed angle of 180°+360°+Δα. If machining tools with smaller diameters are used, small angles of offset are possible. Thus, for example, the diameters of the machining tools 1 to 3 and the angles of offset between them could be selected such that these tools can even be advanced during a rotation of the semiconductor wafer through a feed angle of 90°. The machining of the semiconductor wafer would then only require the time taken for the semiconductor wafer to rotate through an overall feed angle of 90°+360°+Δα. It is therefore preferred as far as possible to use machining tools with small diameters and to keep the angles of offset between the machining tools as small as possible. However, it should also be borne in mind that machining tools with comparatively small diameters also have smaller working surfaces and therefore become worn earlier.

When using two different grinding tools, the throughput of semiconductor wafers when the process described is employed can be increased by about 60% compared to the incremental edge machining which has hitherto been customary.

While several embodiments of the present invention have been shown and described, it is to be understood that many changes and modifications may be made thereunto without departing from the spirit and scope of the invention as defined in the appended claims.

What is claimed is:

1. A process for the material-abrading machining of an edge of a semiconductor wafer, comprising the steps of:

resting the semiconductor wafer on a rotationally movable table;

rotating said wafer about a central axis;

machining said wafer by a plurality of rotating machining tools; each of the machining tools abrading a specific quantity of material from the edge of the semiconductor wafer;

successively advancing the machining tools during the course of a 360° rotation of the semiconductor wafer towards the edge of the semiconductor wafer and ultimately simultaneously machining the edge of the semiconductor wafer, and a machining tool which has just been advanced abrading a smaller quantity from the edge of the semiconductor wafer than a previously advanced machining tool;

terminating the machining of the edge of the semiconductor wafer with one machining tool at the earliest once the semiconductor wafer has rotated through 360°, calculated from advancement of this machining tool; and wherein machining tools which are adjacent during the machining of the edge of the semiconductor wafer rotate in opposite directions of rotation.

2. The process as claimed in claim 1, wherein the machining tools are selected from the group consisting of grinding tools, polishing tools and tools for ductile grinding.

3. The process as claimed in claim 1, comprising bringing the edge of the semiconductor wafer, during the machining, into contact at one point with a liquid cleaning agent, to which ultrasound or megasound has optionally been applied.

4. The process as claimed in claim 1, comprising terminating the machining by withdrawing the machining tools from the edge of the semiconductor wafer in a sequence which corresponds to the sequence in which they were advanced.

5. The process as claimed in claim 1, comprising terminating the machining by withdrawing the machining tools simultaneously from the edge of the semiconductor wafer.

* * * * *